US005704502A

United States Patent [19]

Greenfield

[11] Patent Number: 5,704,502

[45] **Date of Patent: *Jan. 6, 1998**

[54] CLOSURE WITH FOREARM ENGAGING TABS FOR MEDICATION CONTAINERS

[76] Inventor: Brian Greenfield, 3450 Drummond, Apt. 1114, Montréal, Québec, Canada, H3G 1Y2

[ * ] Notice: The term of this patent shall not extend beyond the expiration date of Pat. No. 5,429,257.

[21] Appl. No.: 364,603

[22] Filed: Dec. 27, 1994

Related U.S. Application Data

[63] Continuation-in-part of Ser. No. 978,370, Nov. 18, 1992, Pat. No. 5,429,257, which is a continuation-in-part of Ser. No. 876,438, Apr. 30, 1992, abandoned, which is a continuation of Ser. No. 788,510, Nov. 6, 1991, abandoned.

[51] Int. Cl.[6] ..... B65D 43/26

[52] U.S. Cl. ..... 215/295; 215/305; 81/3.15

[58] Field of Search ..... 215/215, 295, 215/301, 303, 304, 305, 302, 329; 220/288, 284, 304, 286; 81/3.09, 3.14, 3.44, 3.45, 3.56, 3.57

[56] References Cited

U.S. PATENT DOCUMENTS

| | | | |
|---|---|---|---|
| 712,094 | 10/1902 | Raymond | 215/302 X |
| 766,947 | 8/1904 | Heath | 215/305 |
| 775,651 | 11/1904 | Heath | 215/305 |
| 1,207,560 | 12/1916 | Keeran . | |
| 1,636,487 | 7/1927 | Read . | |
| 1,912,969 | 6/1933 | Carvalho | 215/302 |
| 1,993,141 | 3/1935 | Hartwell . | |
| 2,094,567 | 9/1937 | Barnby | 215/302 |
| 2,322,805 | 6/1943 | Johnson | 220/288 |
| 2,483,964 | 10/1949 | Bennett | 220/284 |
| 3,185,332 | 5/1965 | Greenstein . | |
| 3,667,638 | 6/1972 | Cambio, Jr. . | |
| 3,842,790 | 10/1974 | Clark . | |
| 3,885,478 | 5/1975 | Evans . | |
| 4,235,132 | 11/1980 | Kendall . | |
| 4,252,249 | 2/1981 | Beckhardt et al. | 220/288 X |
| 4,311,259 | 1/1982 | Babiol . | |
| 4,469,235 | 9/1984 | Parker . | |
| 4,731,512 | 3/1988 | Barriac . | |
| 4,760,763 | 8/1988 | Trick et al. . | |
| 4,770,069 | 9/1988 | Mikan et al. . | |
| 4,840,093 | 6/1989 | Goldman, Jr. . | |
| 4,911,038 | 3/1990 | Ferrin . | |
| 4,919,015 | 4/1990 | Pohjola . | |
| 4,981,228 | 1/1991 | Kahn . | |
| 5,147,052 | 9/1992 | Minnette | 215/215 |
| 5,255,815 | 10/1993 | Renk et al. | 220/323 |
| 5,429,257 | 7/1995 | Greenfield et al. | 215/305 X |

FOREIGN PATENT DOCUMENTS

| | | |
|---|---|---|
| 38477 | of 1931 | France . |
| 1528335 | 6/1968 | France . |
| 8508220 | of 1985 | Germany . |
| 158786 | of 1933 | Switzerland . |
| 115364 | 5/1918 | United Kingdom . |
| 218531 | 7/1924 | United Kingdom . |
| 366892 | 2/1932 | United Kingdom . |

*Primary Examiner*—Allan N. Shoap
*Assistant Examiner*—Robin A. Hylton
*Attorney, Agent, or Firm*—Darby & Darby

[57] ABSTRACT

An apparatus to assist a person having reduced manual dexterity in removing a cap from a container, the apparatus comprising a base and at least two tabs for removing the cap of the container by manual force against the tabs directly applied by one or more of the users's fingers or a narrow portion of an ulnar side of a forearm of the user. The tabs each extend upright from the base and are spaced from each other for engaging opposite sides of the at least one finger or the forearm. The tabs are arranged for twisting open the cap by turning the forearm or the finger solely by movement of the user's arm, so that gripping of the cap is unnecessary, in order to engage the tabs and rotate the cap in an opening direction while one of the fingers on the palm side and the forearm on the ulnar side is positioned between the tabs and against the base. The tabs may either extend parallel to each other or flare outwardly.

9 Claims, 5 Drawing Sheets

FIG. 4a
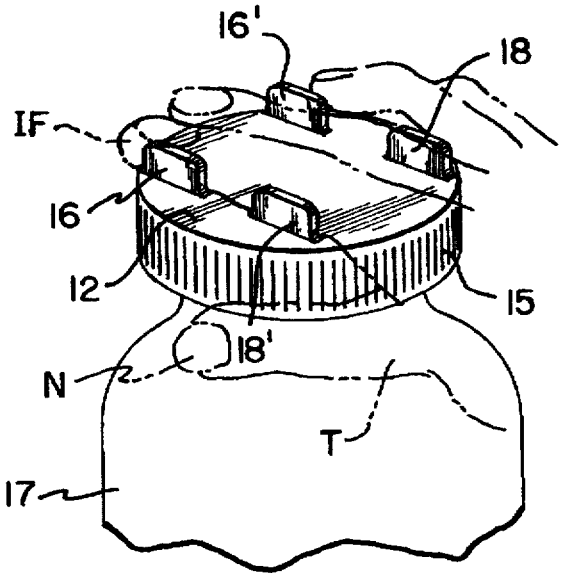
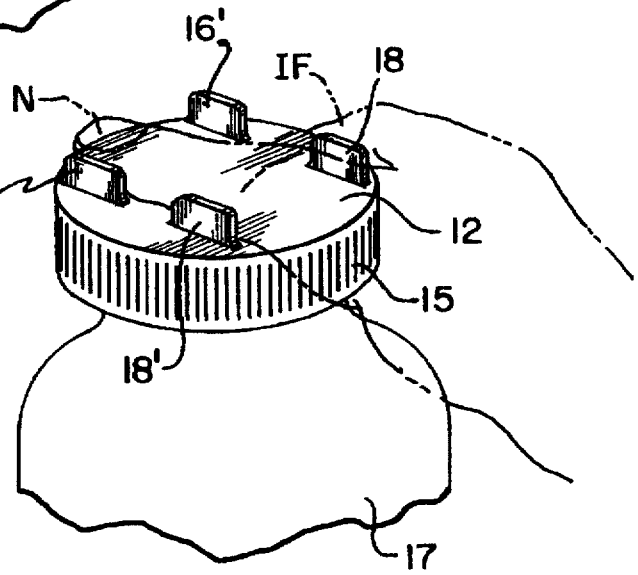
FIG. 4b
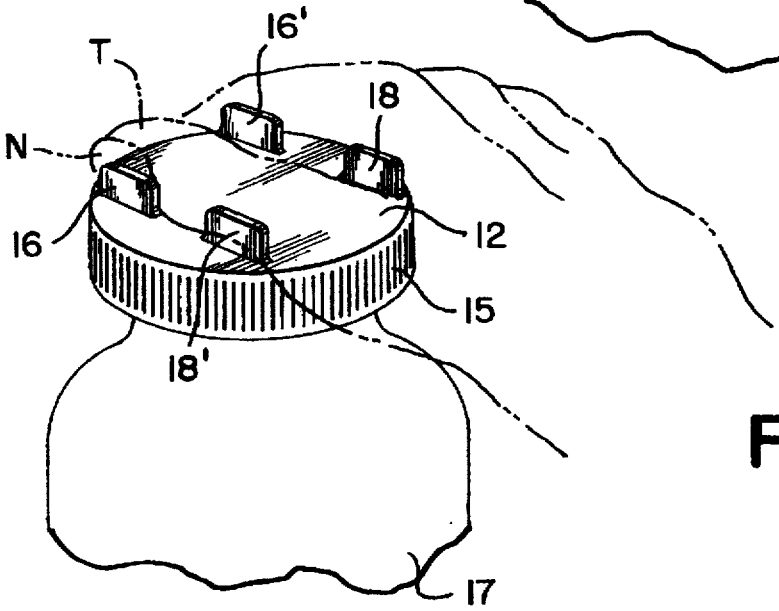
FIG. 4c

CLOSURE WITH FOREARM ENGAGING TABS FOR MEDICATION CONTAINERS

CROSS-REFERENCE TO COPENDING APPLICATIONS

This is a continuation-in-part of application of Ser. No. 07/978,370 filed Nov. 18, 1992, now U.S. Pat. No. 5,429,257, which is a continuation-in-part of application of Ser. No. 07/876,438 filed Apr. 30, 1992, now abandoned, which is a continuation of Ser. No. 07/788,510 filed Nov. 6, 1991, now abandoned. The contents of these applications are incorporated by reference.

BACKGROUND OF THE INVENTION

1. Field of the Invention

The present invention relates to a twist cap or twist closure for a container. Tabs project upwardly from the base of the twist closure to assist a person having reduced manual dexterity, such as an arthritic patient, in removing the closure from a container, such as a medication bottle. The apparatus is to be attached to or made integral with the closure of the container.

2. Discussion of Related Art

Persons with limited manual dexterity in their wist or fingers, such as persons afflicted with arthritis, have difficulties removing twist closures from medication containers. Such persons do not have full use of the their hands, but typically have good control over the movement of their arm or forearm relative to the shoulder. However, control over the relative movement of their wrist or fingers may be difficult if not impossible.

It is known to provide cap removers for medication containers, as is disclosed in U.S. Pat. Nos. 4,760,763, 4,770,069 and 3,885,478, German utility model G 85 08 220.1 and Swiss patent No. 158786. U.S. Pat. No. 4,760,763 discloses a device for opening the cap of a child resistant medication container by reducing the necessary gripping action with one's fingers by relying on the palm of one's hand instead. U.S. Pat. No. 4,731,512 discloses a two-piece, press-twist, child resistant closure which is formed with upwardly extending lugs to assist in holding the closure against rotation while manually pressed. The bottle is rotated relative to the closure. U.S. Pat. No. 4,469,235 describes a closure with upwardly extending tabs to enable manual application of torque to the closure without gripping the side wall thereof. German utility model G 85 08 220.1 discloses a removable closure whose upper surface is defined by a recess between two sidewalls. The recess is used to hold the closure against rotation by engaging a stationary object such as an edge of a table. The bottle is then rotated. Alternatively, an elongated object is inserted in the recess, the bottle is held against rotation, and the object is turned to rotate the closure. The elongated object is exemplified by a pencil, a fork, a fork handle, a knife or a knife handle. Swiss patent No. 158786 discloses a closure device having outwardly extending gripping elements that extend in opposite directions.

In conventional devices, use of a tool or the wrist or fingers is required to grasp and remove the closure.

SUMMARY OF THE INVENTION

The present invention is directed to an apparatus to assist a person having limited manual dexterity of the wrist or fingers in removing a twist cap or closure from a container. In accordance with one aspect of the invention, the apparatus comprises a base and at least two upstanding tabs that project upwardly from the base. The tabs are spaced apart from each other by a distance sufficient for accommodating therebetween the narrow portion of the ulnar side of a user's forearm, wrist or fingers. By pressing down with the forearm, wrist or fingers, depending upon which is accommodated, the user turns the arm and thereby the forearm, wrist and fingers to twist open the twist closure through the engagement with the tabs. The fingers, as used in the application, includes the thumb.

Two tabs may either extend parallel to each other or flare outwardly from one side of the top surface of the twist closure base. The tabs may be spaced apart facing each other and extend fully or partially across the top surface of the base. If they are formed to extend partially across, then another set of tabs may be provided to extend in alignment with the two tabs and project from the other side of the top surface of the twist closure base.

BRIEF DESCRIPTION OF THE DRAWINGS

For a better understanding of the present invention, reference is made to the following description and accompanying drawings, while the scope of the invention is set forth in the appended claims, wherein:

FIGS. 4*a*, 4*b* and 4*c* are perspective views of the embodiment of FIG. 1, but showing alternative manners of opening the closure with the fingers.

DETAILED DESCRIPTION OF PREFERRED EMBODIMENTS

Figure 1:
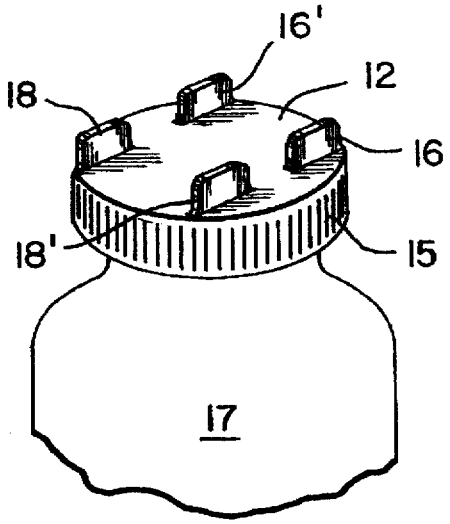
FIG. 1 shows a perspective view of a twist closure attached to a pill bottle in accordance with a first embodiment of the invention.
Figure 2:
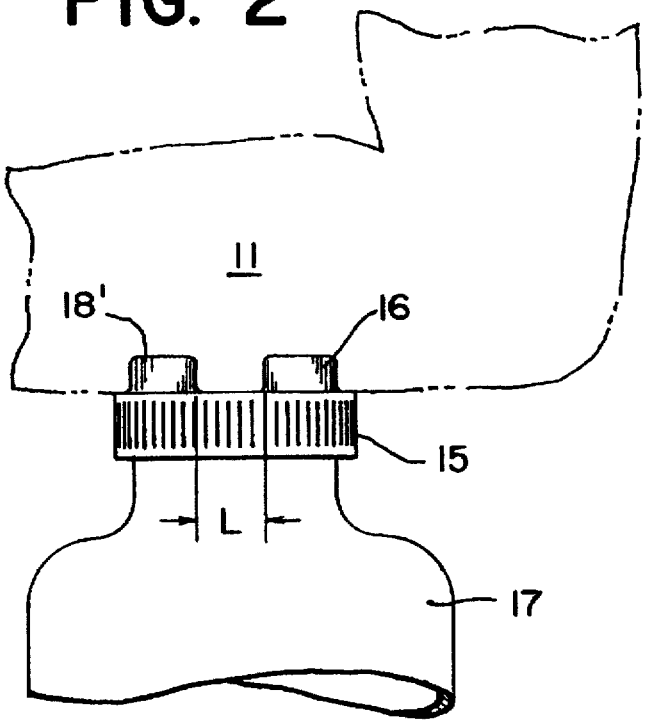
FIG. 2 shows a side view thereof with a forearm represented in dashed line in position for engaging the closure.
Figure 3:
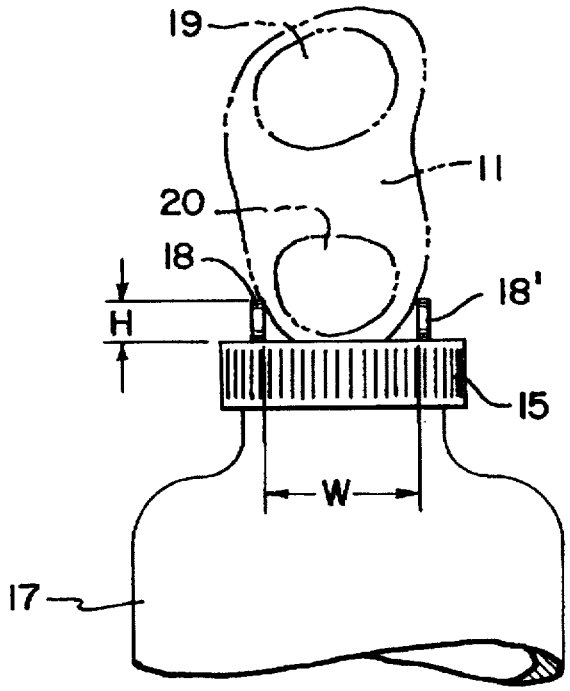
FIG. 3 is a front view thereof with the forearm shown in dashed line and in cross-section.

As shown in FIGS. 1, 2, 3 and 4, a twist closure 15, which is of the push-and-turn type, is provided with two sets of pairs of upstanding tabs 16, 16' and 18, 18', such that when the forearm 11 is placed on base 12 between the tabs 16, 16' and between 18, 18', diagonally opposite ones of the tabs are engaged to turn the closure or cap 15 counterclockwise (for removal) or clockwise (for closure). The tabs 16, 16' and 18, 18' may have parallel contact surfaces facing each other and each tab set is spaced apart by a width W which corresponds to the width of the lower part of the forearm 11. A lengthwise distance L is defined as the length of tabs 16, 18 (or 16', 18') together with the space between them. The height H of the tabs as shown in FIG. 3 is preferably chosen to ensure engagement so that as forearm 11 is twisted, the force transmitted by the ulnar bone 20 does not cause the forearm 11 to rise over tabs 16, 18 or 16', 18' or to injure the forearm. For instance, the height H may correspond to the height from the base 12 to the average middle of the ulnar bone 20 of an average adult when resting on the base 12.

The ulnar bone 20 extends from the wrist to the elbow, and the user may use any portion of the forearm that feels comfortable. For smaller boned patients, as is common with more elderly female patients, the approximate minimum height of the tabs should be ⅜" (roughly 10 mm). For such patients, a suitable minimal widthwise distance in a lateral direction between tabs is 1¼" (32 mm) and a suitable lengthwise distance is also ⅞" (22.5 mm). The lengthwise distance is constituted by the lengths of tabs 16 and 18' and the space, if any, between them. The widthwise distance is twice the distance from one tab to a line passing through the area defined between the tabs and equidistant to the edge of each tab closest to the line.

A suitable range of dimensions is for the tab height to be from about 0.75 cm (about 3/16 inch) to about 1.4 cm (about 9/16 inch) and the lateral widthwise distance between tabs to be from about 2.5 cm (about 1 inch) to about 4.0 cm (about 1 9/16 inches). The tab thickness is about 3 mm so as to be sturdy to avoid bending or breaking off manually. The cap diameter may be 1¾ inches to 3 inches or larger; better results are obtained when the tab height increases within the preferred range as the cap diameter increases. The ratio of the tab height to the lateral widthwise distance between the tabs is substantially about 1:3.

In use, the container 17 is placed on a surface, preferably at waist height with respect to the standing arthritic patient. As shown in FIG. 3, the forearm 11 is placed on base 12 with the tabs protruding upwardly on each side of the forearm to a height approaching the height to the center of the ulnar bone 20 with the radial bone 19 positioned above the ulnar 20 (the forearm is in a relaxed position). In use, some weight is applied to the base 12 to hold fast the container 17 against relative movement with respect to the surface; only a small turning force need be applied thereafter to loosen cap 15 from container 17. Once the cap 15 is loose, additional mining of cap 15, if required, can be carried out using a minimum of force by pushing against the tabs with the forearm or hand to cause the cap 15 to turn.

Since most counter top surfaces provide sufficient friction on the base of container 17 when a little bit of weight is applied to base 12 by forearm 11, the container 17 only needs to be held slightly by the other hand in order to prevent it from slipping or turning. If extra friction is required, then the container 17 can be placed on a cloth or rubber surface which will offer a better frictional contact. The placing of weight by forearm 11, and in particular by ulnar bone 20 does not cause discomfort to the patient and more importantly does not require the use of the wrist joint or finger joints during the cap opening procedure, but of course they may be used if the patient is able.

In accordance with the principles of the present invention, a portion of the user's upper limb other than the ulnar side of the user's forearm, i.e., any one of at least one finger, a plurality of fingers alongside each other, a metacarpal bone region, and a wrist, may be used to open or close the cap. For example, the user's wrist may be inserted between the spaced apart tabs to engage the tabs and thereby turn the cap. Alternatively, other portions of the user's hand may be used, as illustrated in FIGS. 4*a*–4*d*.

FIG. 4*a* illustrates an alternative manner of opening the cap, by using the fingers instead of the forearm. Before the cap is loosened, two or three fingers alongside each other may be used to perform the same movements that the ulnar portion of the forearm performed in the manner depicted in FIGS. 2 and 3. After the cap has been loosened, however, the middle finger or the index finger IF alone could engage the tabs 16, 18 or 16', 18', as applicable for further twisting of the cap on the container. The rest of the hand need only exert slight pressure to open the cap. Arthritic persons, for instance, may prefer keeping the cap loosened rather than tightly closed after the initial opening to ease reuse of the container. Under such circumstances, the ability to turn the cap relative to the container body without the need for gripping the cap to unscrew it is helpful.

FIG. 4*b* illustrates yet another manner of opening the cap, similar to that of FIG. 4*a*, except that finger selected to be placed between the tabs is the thumb. The thumb presses down on the cap while rotating the arm to pivot about the thumb. This causes the thumb to engage diametrically opposite tabs. By rotating the arm in the counterclockwise direction, the thumb twists open the cap through engagement with the tabs.

The thumb T need not have the palm side pressing the base between the tabs. Instead, the thumb T may be placed on its side between the tabs so that the nail N of the thumb T presses against the inner facing surface of a distal tab and the fleshy surface of the thumb by the joint with the hand presses against the diametrically opposite proximal tab. This is depicted in FIG. 4*c*.

Figure 4D:
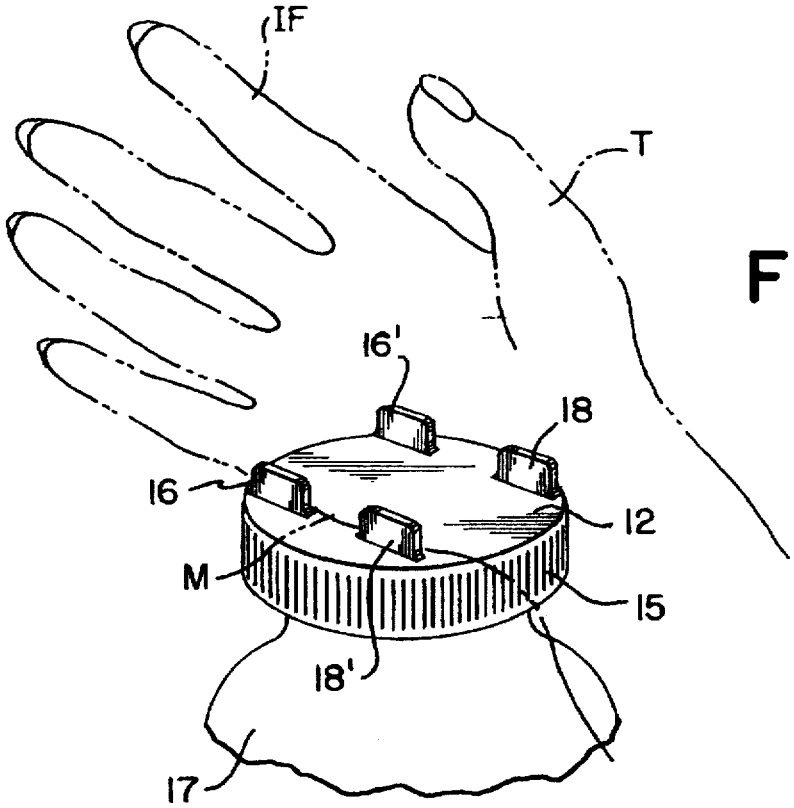
FIG. 4*d* is a perspective view as in FIGS. 4*a*–4*c*, except showing an further alternative manner of opening the closure in this case with the metacarpal bone region of the hand.

FIG. 4*d* shows the medial or ulnar aspect of the fifth metacarpal bone of the hand extended between the tabs for opening the cap. The lateral or radial aspect of the first metacarpal bone of the hand may be extended between the tabs in a similar manner for opening the cap.

Figure 5A:
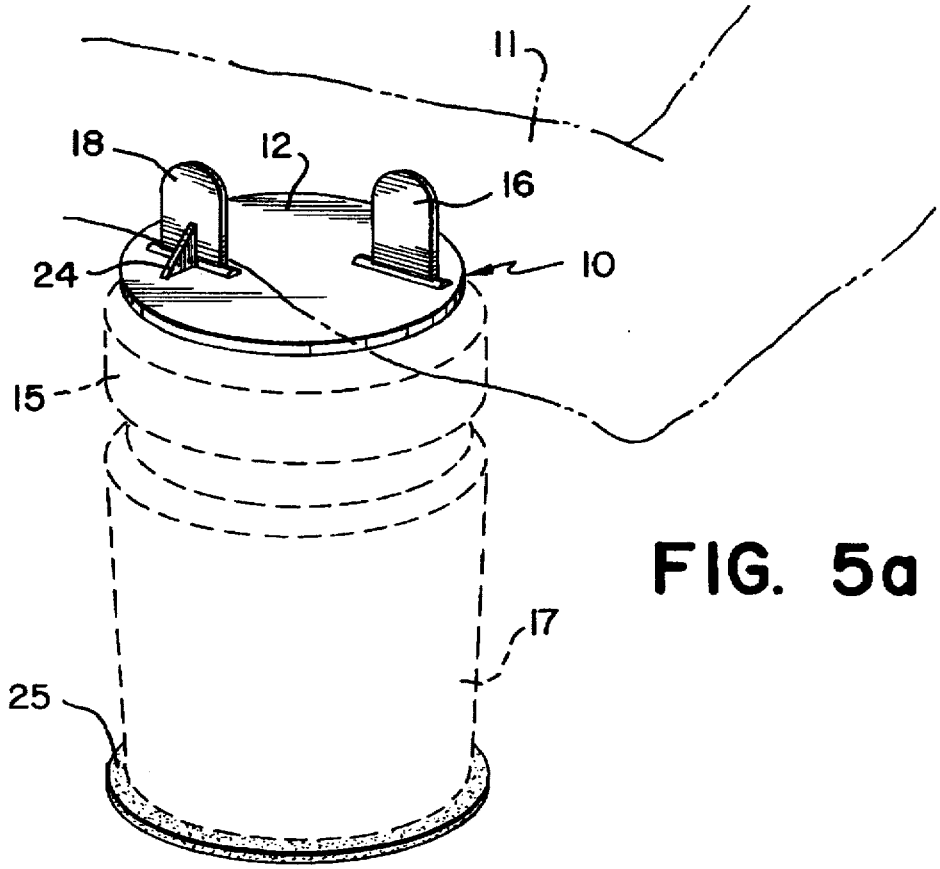
FIG. 5*a* is a perspective view of a second embodiment.
Figure 5B:
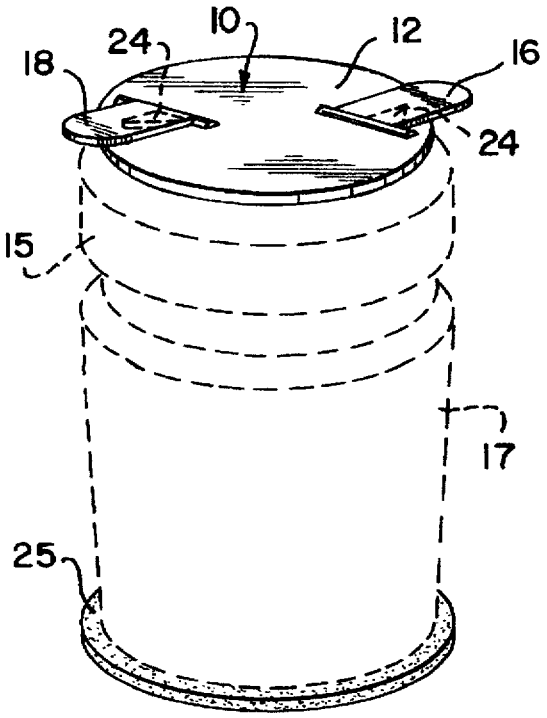
FIG. 5*b* is a view similar to FIG. 5*a*, but showing the tabs in a folded, down position.
Figure 5C:
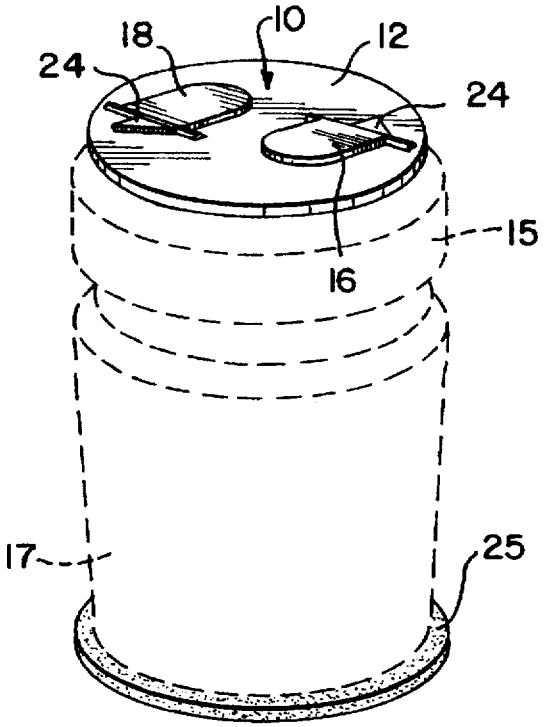
FIG. 5*c* is a view similar to FIG. 5*b*, but showing the tabs folded in the opposite direction.

In the embodiment shown in FIG. 5*a*, the apparatus 10 comprises a base 12 to which two tabs 16 and 18 are pivotally connected. The two tabs 16 and 18 are arranged in such a position that a person's forearm 11 can be placed therebetween in order to provide a twisting action. In this embodiment it is preferable that the cap 15 of the bottle 17 be relatively large, i.e., having a diameter of approximately 3 to 6 inches. Each tab 16 and 18 includes a gusset 24 which braces the tabs 16 and 18 in an upright position while being twisted by forearm 11. When the apparatus 10 is not in use, the gusset 24 can be moved, e.g., tilted to one side, the tabs 16 and 18 can be folded down such that they lie substantially flat on base disk 12, as shown in FIGS. 5*b* and 5*c*. The apparatus 10 is shown as being an attachment to cap 15. Tabs 16 and 18 may instead be incorporated directly into a base being provided by formations in cap 15. In order to prevent bottle 17 from twisting while being turned by apparatus 10, a rubber pad 25 can be used underneath bottle 17 in case that bottle 17, which is usually made of plastic construction, has a tendency to slip on most smooth counter top surfaces. Using the rubber pad 25, even a small amount of weight applied by forearm 11 will ensure a non-slip holding for bottle 17 and the twisting action provided by apparatus 10 will facilitate opening of cap 15 without requiring manual dexterity.

Figure 6A:
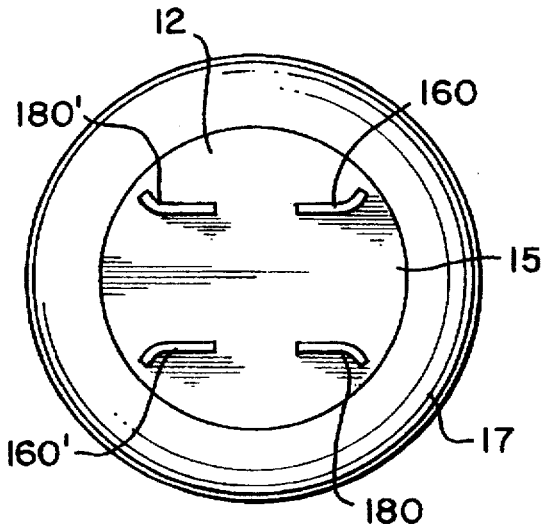
FIG. 6*a* is a top view of a third embodiment which is a variation of that of FIG. 1.
Figure 6B:
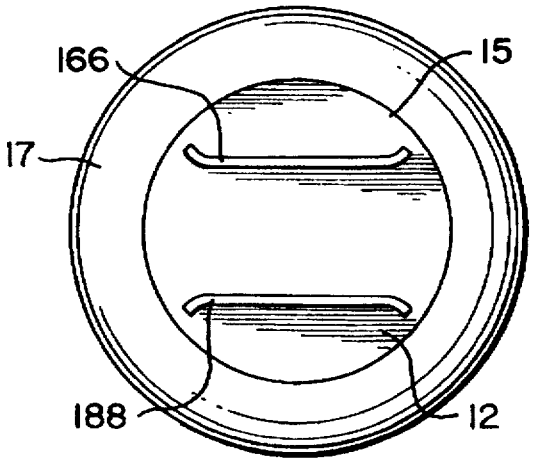
FIG. 6*b* is a view similar to FIG. 6*a*, but showing only two of tabs, rather than four tabs.

With respect to the embodiments of FIGS. 1–4 6*a*, and 6*b* tabs 16 or 18 may be extendable to join with tabs 18' or 16', respectively, so to form two elongated, continuous tabs with substantially parallel surfaces facing each other. These tabs provide additional guidance for opening the container and, more importantly, for providing engagement surfaces to turn the cap in a clockwise direction in order to close the container. During fabrication, tabs 16' and 18' may be arranged angularly shifted with respect to tabs 16 and 18, so that the opposing surfaces are no longer parallel to each other, as long as the pair of tabs 16, 18 and 16', 18' engage forearm 11 in such a way that turning the forearm 11 causes the ulnar bone 20 to turn base 12 and thus cap 15 in the desired direction. If desired, the side section of the tabs may be flared outwardly in the manner depicted in FIG. 6 with respect to tabs 180, 160, 180', and 160'; such flaring provides additional comfort for the user's forearm. These tabs may also be extended to join tab 160 with tab 180 into single tab 166 and to join tab 160' with tab 180 into single tab 188, as shown in FIG. 6*b*. Likewise, in the embodiment of FIG. 5, the tabs 16, 18 may be further extended across the cap.

Figure 7:
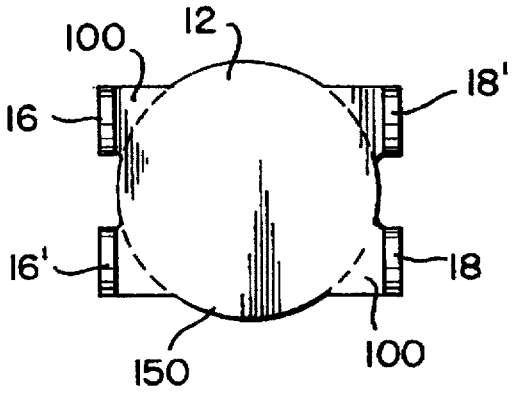
FIG. 7 is a top view of a fourth embodiment which is a variation of that of FIG. 1.
Figure 8:
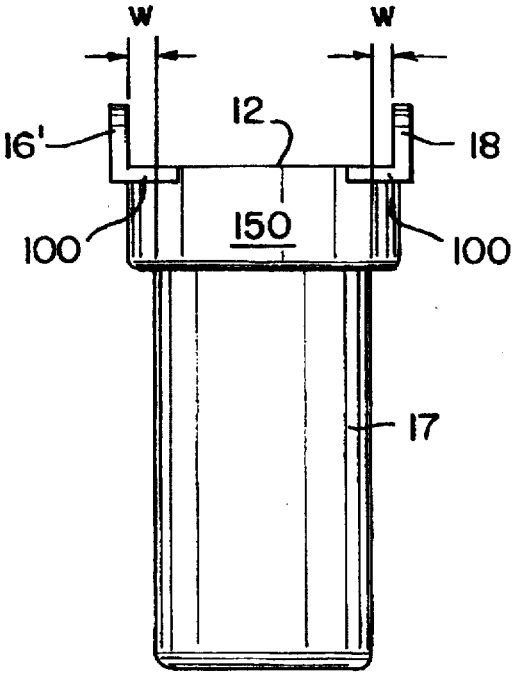
FIG. 8 is a from elevational view of the embodiment of FIG. 7.

FIGS. 7 and 8 show another embodiment of the invention that is a variation of that of FIGS. 1–3. In instances where a container 17 has an opening which is narrower than a patient's ulnar bone, a closure 150 may be provided which includes an extension portions 100 on which the tabs 16, 16', and 18, 18', respectively, can be mounted so as to be spaced from each other by a width sufficient to receive a user's forearm. Thus, as shown in FIG. 8, the closure 150 which is on a container 17 that has an opening that is narrower than the width of a typical user's forearm, may have extensions 100, each extension having an extended width w such that the diameter of the opening plus 2w is a distance sufficient to receive a user's forearm.

While the base 12 may be provided integrally with cap 15, it is of course possible to make an attachment apparatus in which base 12 is provided separate from cap 15 and merely attaches or is adhered to an ordinary cap 15. Snaps, adhesive strips or a friction fit over the cap 15 are some of the possible ways to connect the base 12 to the cap 15. The twist cap or closure 15 can be a conventional screw cap or a two-piece push-and-turn closure in which the outer base slips until depressed to engage an inner screw cap.

Figure 9:
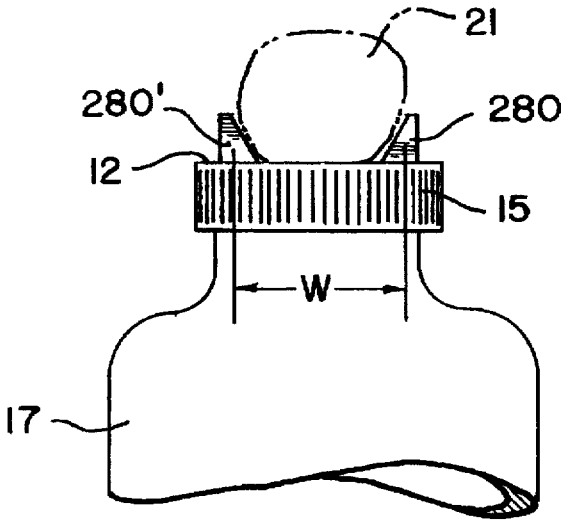
FIG. 9 is a front elevational view of an embodiment that is a variation of that of FIG. 3 in that the tabs are inclined and the wrist is shown in dashed line and in cross-section.

FIG. 9 shows a variation of the embodiment of FIGS. 1–3 in that tabs 280, 280' incline outwardly and upwardly from the base instead of extending purely vertical. The tabs extend from the base at substantially the stone location as in FIGS. 1–3 so as to be separated by the width W. Accordingly, the side sections of the contact surfaces of the tabs are at least as far from each other as the remaining sections of the contact surfaces of the tabs so that the tabs do not dig into the user's wrist, or other portion of the user's upper limb, during use. By inclining in this manner, the tabs will not dig into the user's wrist 21 during engagement unlike the case for the embodiment of FIGS. 1–3. The angle of the incline is selected to ensure engagement of the tabs for opening the cap and so as to widen the gap between the tabs to accommodate the widening width of the wrist 21 as the elevation from the base of the cap increases.

Figure 10:
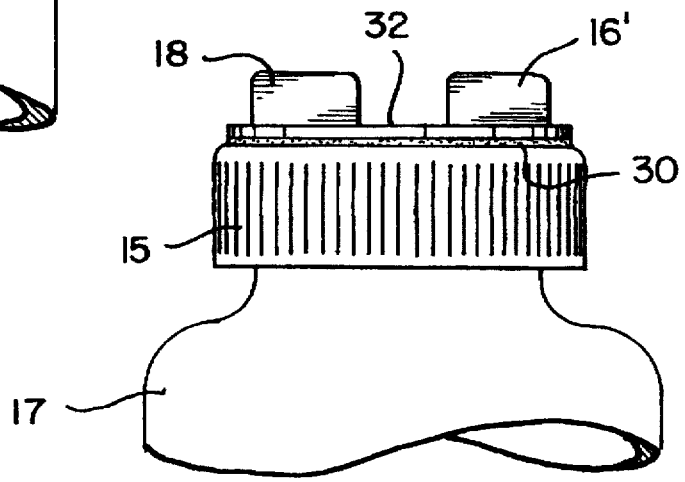
FIG. 10 is an elevational view of a further embodiment of a tabbed base of the invention secured to twist closure cap.

FIG. 10 shows a further embodiment in which a rubbery adhesive 30, such as dysem, is applied to the top of the conventional cap 15 and a base 32 with projecting upright tabs 16', 18 is applied atop the adhesive. For the sake of brevity, only tabs 16', 18 are shown in FIG. 10, but it should be understood that any of the other tab arrangements in the other embodiments may be used as well. Further, the present invention may be applied to caps requiring any degree of turning before becoming sufficiently loose for removal, e.g., those requiring a full turn or those requiring a quarter turn to twist off.

All the embodiments may employ outwardly and upwardly inclined tabs as in FIG. 9 instead of tabs that extend vertically only. Further, only two tabs are necessary to allow for the cap to twist open in each of the embodiments so that only two tabs need be provided instead of four. The two tabs preferably are diametrically opposite each other and arranged to permit engagement for counterclockwise rotation. Alternatively, the tabs may be facing opposite each other. If desired, three tabs or more than four tabs may be employed, preferably arranged on the cap to permit a torque transmitting engagement with the closure for twisting open the cap; i.e., they have vertical surfaces in alignment with neighboring ones of the vertical surfaces of other ones of the tabs.

It is to be understood that the above description of the preferred embodiment is not intended to limit the scope of the present invention as defined in the appended claims.

What is claimed is:

1. An apparatus to assist a user, including a person having reduced manual dexterity, in removing a cap from an opening of a container or securing it to the opening of the container, the apparatus comprising:

a base for extending across the top of the cap, a midline in the plane of said base passing generally through the midportion of said base; and means for rotating said base to thereby rotate the cap on the container by manual force, said rotating seam including at least two tabs each extending substantially upright from said base and spaced from each other and substantially equidistant from the midline, said tabs having opposed contact surfaces spaced apart from each other by a distance that accommodates placing a portion of the user's upper limb between s,lid contact surfaces to press against the portion of said base extending between said tabs and said contact surfaces of said tabs, the engagement of said portion of the user's upper limb against said base and said connect surfaces of said tabs while turning the user's upper limb causing a torque to be applied to said base, and hence to the cap, so as to cause a twisting movement of the cap for selectively loosening and securing the cap depending upon a direction of the twisting movement, each opposing contact surface facing in a direction towards the midline and having a top and a bottom, each said contact surface further comprising a first section extending upright from said base from said bottom to said top, and a side section extending upright from said base from said bottom to said top a side of said first section facing the periphery of said base, said first sections of said opposing contact surfaces of said tabs being parallel to each other, and said side sections of said opposing contact surfaces of said tabs diverging away from the midline in the said base and towards the periphery of said base.

2. The apparatus of claim 1, wherein said at least two elongated tabs include first, second, third and fourth tabs, said first and second tabs facing opposite each other and being spaced apart from each other, said third and fourth tabs facing opposite each other and being spaced apart by substantially the stone distance as that of said first and second tabs and mirroring said first and second tabs.

3. The apparatus of claim 1, wherein said base is integrally formed with and composed of the same material as that of a remainder of the cap.

4. The apparatus of claim 1, wherein said contact surfaces of said tabs are substantially convex in the plane of said base and relative to the midline.

5. An apparatus to assist a user, including a person having reduced manual dexterity, in removing a cap from an opening of a container or securing it to the opening of the container, the apparatus comprising:

a base for extending across the top of the cap and having at least one extension projecting laterally outwardly from a remainder of the base; and means for rotating the cap on the container by manual force, said rotating means including at least two tabs each extending upright from said extension and spaced from each other, said tabs having opposed contact surfaces spaced apart from each other by a distance that accommodates placing a portion of the user's upper limb between said contact surfaces so as to press against said base between said tabs while engaging said contact surfaces of said tabs and effecting a turning movement of the cap by rotation of the upper limb for selectively loosening and completely securing the cap on the container, depending upon a direction of the turning movement.

6. Apparatus as claimed in claim 6, further comprising an additional two tabs facing opposite each other and having contact surfaces spaced apart from each other by substantially the same distance as that of the contact surfaces of the first mentioned tabs, said base having another extension projecting outwardly in a direction opposite to that of the first mentioned extension, said additional tabs extending upright from said additional extension.

7. An apparatus for assisting a user, including a person having reduced manual dexterity, in removing a cap from an opening of a container or securing the cap to the opening of the container, the apparatus comprising:

a base for extending across the top of the cap;

means for rotating the cap of the container by manual force, said rotating means including at least two tabs each extending upright from said base, said tabs having opposed contact surfaces spaced apart from each other by a distance that accommodates placing a portion of the user's upper limb so as to press against said base between said contact surfaces of said tabs while engaging said contact surfaces of said tabs and effecting a turning movement of the cap by rotation of the upper limb for selectively loosening and completely securing the cap on the container, depending upon a direction of the turning movement;

hinge means for pivoting said tabs upright from a position in which said tabs extend substantially flat along said base; and means for maintaining said tabs in an upright position.

8. A method of assisting a person in causing a cap to be removed from or secured to an opening of a container, the method comprising the steps of:

removing a cap of the container by manual force through engagement of at least two tabs each extending upright from a base and spaced from each other, said tabs having contact surfaces spaced apart from each other by a distance that accommodates pressing any one of at least one finger, a metacarpal bone region of a hand, a wrist, and an ulnar side of a forearm against the base between said tabs while engaging said contact surface of said tabs and effecting a turning movement of the cap for selectively loosening and completely securing the cap on the container, depending upon a direction of the turning movement;

pivoting said tabs upright from a position in which said tabs extend substantially flat along said base; and positioning means against said tabs to maintain said tabs in said upright position.

9. The apparatus of claim 1, wherein:

said tabs include a single tab on a first side of the midline and a single tab on a second side of the midline, said labs having opposed contact surfaces facing in a direction towards the midline;

said contact surface of said single tab on said first side of said midline comprises the first section and side sections on each side of said first section;

each of said section of said single tab on said first side of the midline diverges away from the midline in the plane of said base and towards the periphery of said base;

said contact surface of said single tab on said second single tab on said second side of the midline comprises the first section and side on each side of said first section; and each of said side sections of said single tab on said second side of the midline diverges away from the midline in the plans of said base and toward, the periphery of said base.

* * * * *